United States Patent [19]

Minamoto et al.

[11] Patent Number: 4,823,754

[45] Date of Patent: Apr. 25, 1989

[54] RETAINING APPARATUS FOR FUEL INJECTOR IN INTERNAL COMBUSTION ENGINE

[75] Inventors: Naoki Minamoto, Toyota; Takuya Isobe, Takaoka, both of Japan

[73] Assignee: Aisin Seiki Kabushiki Kaisha, Kariya, Japan

[21] Appl. No.: 152,826

[22] Filed: Feb. 5, 1988

[30] Foreign Application Priority Data

Feb. 9, 1987 [JP] Japan ..... 62-017669[U]

[51] Int. Cl.[4] ..... F02M 39/00

[52] U.S. Cl. ..... 123/470; 123/456; 123/468

[58] Field of Search ..... 123/468, 469, 470, 471, 123/472, 456, 467

[56] References Cited

U.S. PATENT DOCUMENTS

| | | | |
|---|---|---|---|
| 4,307,693 | 12/1981 | Glockler | 123/469 |
| 4,474,159 | 10/1984 | Katnik | 123/470 |
| 4,474,160 | 10/1984 | Gartner | 123/468 |
| 4,475,516 | 10/1984 | Atkins | 123/470 |
| 4,539,961 | 9/1985 | Atkins | 123/468 |
| 4,570,602 | 2/1986 | Atkins | 123/468 |

*Primary Examiner*—Carl Stuart Miller

*Attorney, Agent, or Firm*—Oblon, Fisher, Spivak, McClelland & Maier

[57] ABSTRACT

A retaining apparatus for a fuel injector in an internal combustion engine includes a main fuel delivery pipe, an auxiliary fuel delivery pipe branched off from the main fuel delivery pipe, a fuel injector airtightly inserted in the auxiliary fuel delivery pipe via a sealing member and being provided with a fuel from the main fuel delivery pipe through the auxiliary fuel delivery pipe. A retaining member rotatably retains the fuel injector on the auxiliary fuel delivery pipe and is slidably mounted on the main fuel delivery pipe.

6 Claims, 2 Drawing Sheets

RETAINING APPARATUS FOR FUEL INJECTOR IN INTERNAL COMBUSTION ENGINE

BACKGROUND OF THE INVENTION

1. Field of the Invention:

This invention relates to a retaining apparatus for a fuel injector in an internal combustion engine. More particularly, it relates to a retaining apparatus for retaining a fuel injector on an auxiliary fuel delivery pipe branched off from a main fuel delivery pipe.

2. Discussion of the Background Art:

A conventional retaining apparatus for a fuel injector in an internal combustion engine is shown in FIG. 6. There, a fuel injector 1 is connected to an auxiliary fuel delivery pipe 3 branched off from a main fuel delivery pipe 2 via a connector 4 threaded into both the fuel injector 1 and the auxiliary fuel delivery pipe 3, so as to communicate the fuel injector 1 with the main fuel delivery pipe 2 in an airtight fashion. However in the foregoing structure, it is not easy to connect the fuel injector 1 to the auxiliary fuel pipe 3 due to the screw connection. Also it is difficult to adjust to a preset position a socket 5 formed on an outer circumferential portion of fuel injector 1 for supplying an electric signal to the fuel injector 1 from a computer etc., while assuring airtightness at the threaded screw connections.

SUMMARY OF THE INVENTION

The present invention is directed to solving the foregoing disadvantages in the prior art.

Therefore, one object of the present invention is to provide a retaining apparatus which can retain a fuel injector to an auxiliary fuel delivery pipe in an airtight manner without any screw connections.

Another object of the present invention is to provide a retaining apparatus which can retain a fuel injector to an auxiliary fuel delivery pipe with minimum manipulations.

These and other objects are achieved according to the invention by a retaining apparatus for airtightly retaining a fuel injector on the auxiliary fuel delivery pipe of an internal combustion engine having an elongate main fuel delivery pipe and at least one auxiliary fuel delivery pipe. The retaining apparatus comprises a cylindrical portion of the fuel injector being sealingly fitted in the auxiliary fuel delivery pipe for delivering fuel from the auxiliary fuel delivery pipe to the fuel injector, and retaining means slidably mounted on the main fuel delivery pipe and cooperating with the fuel injector for rotatably retaining the fuel injector on the auxiliary fuel delivery pipe.

Consequently, according to the present invention, it is easy to retain the fuel injector on the auxiliary fuel delivery pipe and the axial length of the fuel injector can be decreased due to no connector being arranged between the fuel injector and the auxiliary fuel delivery pipe. Furthermore, it is easy to adjust the electrical connection socket to a preset position, the socket being formed on an outer circumferential surface of the fuel injector for supplying an electric signal to the fuel injector from a computer etc., due to the fuel injector being rotatably retained on the auxiliary fuel delivery pipe by the retainer.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein.

DETAILED DESCRIPTION OF THE PREFERRED EMBODIMENTS

Figure 3:
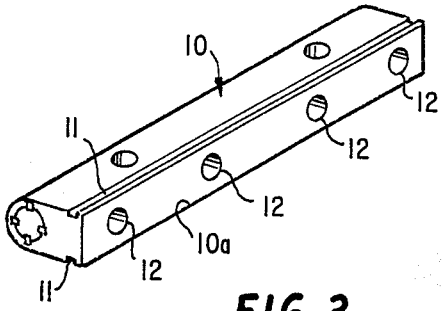
FIG. 3 is a perspective view of a main fuel delivery pipe in the present invention.

Referring now to the drawings, there is shown in FIG. 3 a main fuel delivery pipe 10 having four auxiliary fuel delivery pipes 12 on a surface 10*a*. Longitudinal slots 11, which may be formed during the extrusion of the pipe 10, are formed in the top and bottom surfaces of pipe 10 at a portion of pipe 10 near the surface 10*a*, the slots 11 extending along the entire longitudinal length of the pipe 10.

Figure 1:
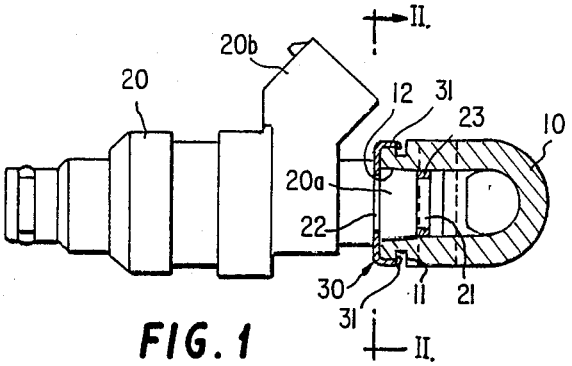
FIG. 1 is a cross-sectional view of the first embodiment of the present invention.
Figure 2:
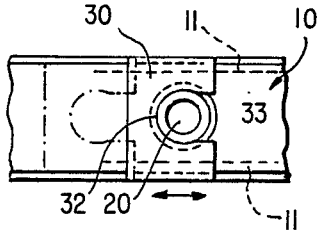
FIG. 2 is a cross-sectional view taken along the line II—II of FIG. 1.

As shown in FIG. 1, a fuel injector 20 has a cylindrical portion 20*a* which is inserted in the auxiliary fuel delivery pipe 12. The cylindrical portion 20*a* has a circular slot 21 and a circular slot 22 is also formed at a junction of the cylindrical portion with the main portion of the fuel injector. An O-ring 23 as a sealing member is inserted in the circular slot 21. An electrical connection socket 20*b* for connection to an element supplying an electric signal from a computer (not shown) to the fuel injector 20 is integrally formed on an outer circumferential surface of the fuel injector 20.

Figure 4:
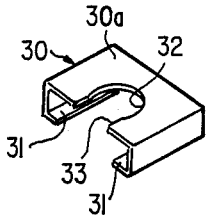
FIG. 4 is a perspective view of one embodiment of a retainer in the present invention.
Figure 5:
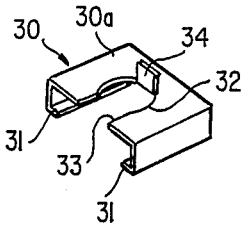
FIG. 5 shows a variation of the retainer according to the invention.
Figure 6:
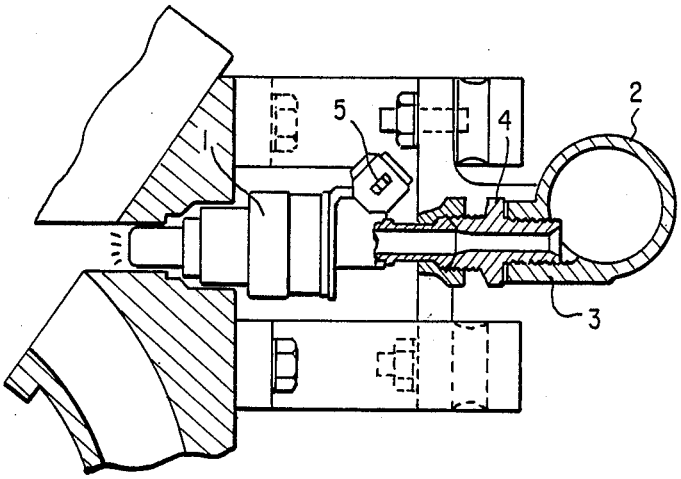
FIG. 6 PRIOR ART
FIG. 6 shows a conventional retaining apparatus for a fuel injector.

As shown in FIG. 4, a retainer 30 is in the form of a channel shaped member made of a resilient material such as sheet metal and has flanges 31 formed thereon by bending. The retainer 30 has a circular opening 32 on a plane surface 30*a* thereof and also has a connecting opening 33 on the surface 30*a* for connecting the circular opening 32 with an edge of the retainer. The diameter of circular opening 32 is larger than that of slot 22 but smaller than that of the cylindrical portion 20*a*. A width of opening 33 is smaller than the diameter of slot 22. The retainer 30 is slidably mounted on the main delivery pipe 10 with the surface 30*a* parallel to the longitudinal direction of the pipe 10 and covering surface 10*a* by inserting the flanges 31 in the slots 11 with the edge to which the opening 33 connects extending transverse to the direction of elongation of the main fuel delivery pipe 10. The variant of the retainer 30 shown in FIG. 5 additionally has a guide wall 34 for guiding the fuel injector 20 during installation or removal. The guide wall 34 extends from a portion of the surface 30*a* adjacent the circular opening 32 and circumferentially opposite the connecting opening 33. The guide wall 34 is in the form of a planar wall extending away from the flanges 31 in a direction transverse to both the surface 30*a* and the direction of elongation of the main fuel delivery pipe 10.

The fuel injector 20 is retained to the main delivery pipe 10 as follows.

The cylindrical portion 20*a* of the fuel injector 20 is inserted in the auxiliary fuel delivery pipe 12 as shown in FIG. 1. The seal between fuel injector portion 20*a* and auxiliary fuel delivery pipe 12 is maintained airtight by O-ring 23. By then sliding the retainer 30 mounted in the slots 11 of the main fuel delivery pipe 10 along the slots 11, the circular slot 22 of fuel injector 20 is inserted through the opening 33 of retainer 30 while elastically deforming the retainer and then into the circular opening 32 of the retainer 30, at which time the retainer elastically snaps back. As a result, the fuel injector 20 is securely retained on the auxiliary fuel delivery pipe 12 by the retainer 30.

Obviously, many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. In an internal combustion engine having an airtight main fuel delivery pipe, at least one auxiliary fuel delivery pipe branched off therefrom and at least one fuel injector, an apparatus for airtightly retaining said fuel injector on said auxiliary fuel delivery pipe, comprising:

a cylindrical portion of said fuel injector being sealingly fitted in said auxiliary fuel delivery pipe for permitting delivery of fuel from said auxiliary fuel delivery pipe to said fuel injector; and resilient retaining means slidably mounted on main fuel delivery pipe and cooperating with said fuel injector for rotatably retaining said fuel injector on said auxiliary fuel delivery pipe, including at least one longitudinal slot formed on said main fuel delivery pipe for slidably mounting said retaining means, said retaining means having a flange inserted in each said slot, including a circular slot formed in said cylindrical portion, wherein said retaining means has a surface defining a circular opening with a diameter larger than that of said circular slot and a connecting opening connecting said circular opening with an edge of said retainer and having a width smaller than the diameter of said circular slot, wherein said edge extends transverse to the direction of elongation of said main fuel delivery pipe when said retaining means is mounted thereon, said surface of said retaining means covering said surface of said main fuel delivery pipe when said retaining means is mounted thereon, and wherein said retaining means has guide wall means for guiding said fuel injector during installation and removal, said guide wall means extending from a portion of said surface adjacent said circular opening and circumferentially opposite said connecting opening, said guide wall means comprising a planar wall extending in a direction transverse to both said surface and said direction of elongation of said main fuel delivery pipe.

2. The internal combustion engine of claim 1 wherein said main fuel delivery pipe has two of said longitudinal slots positioned on opposing sides of a surface to which said at least one auxiliary fuel delivery pipe extends.

3. The internal combustion engine of claim 1 including an electrical connection socket integrally mounted on said fuel injector.

4. The internal combustion engine of claim 1 including a sealing member mounted on said cylindrical portion of said fuel injector.

5. The internal combustion engine of claim 4, wherein said sealing member is an O-ring.

6. the internal combustion engine of claim 1 wherein said guide wall means extends in a direction away from said flange.

* * * * *